US009386376B2

(12) United States Patent
Tada et al.

(10) Patent No.: US 9,386,376 B2
(45) Date of Patent: Jul. 5, 2016

(54) SPEAKER ASSEMBLY FOR A HIGH-TEMPERATURE ENVIRONMENT

(71) Applicant: Alpine Electronics, Inc., Tokyo (JP)

(72) Inventors: Arata Tada, Iwaki (JP); Ryo Ito, Iwaki (JP)

(73) Assignee: Alpine Electronics, Inc., Tokyo (JP)

( * ) Notice: Subject to any disclaimer, the term of this patent is extended or adjusted under 35 U.S.C. 154(b) by 360 days.

(21) Appl. No.: 13/790,003

(22) Filed: Mar. 8, 2013

(65) Prior Publication Data

US 2013/0272537 A1 Oct. 17, 2013

(30) Foreign Application Priority Data

Apr. 17, 2012 (JP) ..... 2012-093966

(51) Int. Cl.
*H04R 9/02* (2006.01)
*H04R 31/00* (2006.01)

(52) U.S. Cl.
CPC ..... *H04R 9/022* (2013.01); *H04R 31/00* (2013.01); *H04R 2499/13* (2013.01); *Y10T 29/49005* (2015.01)

(58) Field of Classification Search
CPC ..... H04R 1/00; H04R 1/025; H04R 1/026; H04R 2499/13; H04R 5/02; H04R 7/125; H04R 9/06; H04R 9/022; H04R 31/00; B60R 2001/1276; B60R 11/0217; Y10T 29/49005
USPC ..... 381/59, 60, 86, 89, 332, 386, 397, 426
See application file for complete search history.

(56) References Cited

U.S. PATENT DOCUMENTS

| | | | | |
|---|---|---|---|---|
| 2,233,459 | A * | 3/1941 | Caulton et al. | 181/150 |
| 5,629,502 | A * | 5/1997 | Nakano | 181/156 |
| 6,310,958 | B1 | 10/2001 | Eisner | |
| 6,516,076 | B1 * | 2/2003 | Marlin | 381/340 |
| 6,517,744 | B1 * | 2/2003 | Hara et al. | 252/506 |
| 2007/0195503 | A1 | 8/2007 | Xue et al. | |

FOREIGN PATENT DOCUMENTS

WO WO2011/047435 4/2011

OTHER PUBLICATIONS

Extended European Search Report dated Mar. 20, 2015 for EP13163903, 7 pgs.

* cited by examiner

*Primary Examiner* — Antim Shah
(74) *Attorney, Agent, or Firm* — Brinks Gilson & Lione

(57) ABSTRACT

A speaker includes a magnetic circuit, a voice coil, and a diaphragm which are disposed in a case. The case is placed in an engine compartment of an automobile. Reproduced sound is emitted through a duct protruding outward from the case. A partition wall, which is a metal body frame of the automobile, is present between the engine compartment and the cabin space. The duct is inserted into a hole formed in the partition wall so that a sound port faces and protrudes into the cabin space. A heat dissipation port is formed in the case, and an end surface the magnetic circuit facing the partition wall is exposed in the heat dissipation port. An elastically deformable thermal conductive sheet is sandwiched between the partition wall and the end surface of the magnetic circuit.

18 Claims, 3 Drawing Sheets

SPEAKER ASSEMBLY FOR A HIGH-TEMPERATURE ENVIRONMENT

RELATED APPLICATIONS

The present application claims priority to Japanese Patent Application Number 2012-093966, filed Apr. 17, 2012, the entirety of which is hereby incorporated by reference.

BACKGROUND

1. Field of the Invention

The present invention relates to an electrodynamic speaker that is preferably used in vehicles or the like, and in particular, to such a speaker that can be installed in a high-temperature environment such as an engine compartment.

2. Description of the Related Art

When a relatively large car speaker for reproducing sounds in a low-frequency range, such as a subwoofer, is installed in a vehicle cabin, the available space in the vehicle cabin is reduced. Therefore, in recent years, a method has been used in which a speaker is disposed in a space outside of a vehicle cabin, and reproduced sound generated by the speaker is emitted to a space inside of the vehicle cabin through an opening formed in a wall of the vehicle cabin. However, it may be difficult to form a large opening in a wall of a vehicle cabin so as to face the diaphragm of a speaker.

Technologies have been proposed with which a duct is formed so as to protrude from a case (cabinet), which is the enclosure of a speaker, and the duct is inserted into a hole formed in a wall of a vehicle cabin so that a space in the case, which is disposed outside of a vehicle cabin, communicates with a space in the vehicle cabin through the duct (see, for example, International Publication No. WO2011/047435). With such a speaker, reproduced sound generated in the case is emitted through a distal open end of the duct into a cabin space, which is an acoustic space. Therefore, the distal open end of the duct is a sound port.

When installing a speaker in an installation space outside of a vehicle cabin of an automobile, a space in a trunk or a space in a door is usually used as the installation space. An engine compartment also has a relatively large extra space in which a speaker can be installed. However, when a speaker is installed in a high-temperature environment such as an engine compartment, the temperature of a voice coil becomes excessively high. As a result, the voice coil may become loose, the neodymium (Nd) magnet used in a magnetic circuit may become demagnetized, or other faults may occur. Therefore, when installing a speaker in a high-temperature environment such as an engine compartment, it is necessary to take special measures to efficiently dissipate heat of the speaker.

SUMMARY OF THE INVENTION

Accordingly, it is an object of the present invention to provide a speaker that can be used when installed in a high-temperature environment.

According to one embodiment of the invention, a speaker includes a magnetic circuit having a magnetic gap; a voice coil disposed in the magnetic gap; a diaphragm that vibrates together with the voice coil; a case in which the magnetic circuit, the voice coil, and the diaphragm are disposed; and a duct protruding from the case, the duct including a sound port that is a distal open end of the duct, the sound port facing and protruding into an acoustic space. The case is disposed in an outer space that is separated from the acoustic space by a partition wall made of a metal. The speaker is installed in such a way that the duct is inserted into a hole that is formed in the partition wall. A heat dissipation port in which an end surface of the magnetic circuit facing the partition wall is exposed is formed in the case, and an elastically deformable thermal conductive sheet is inserted into the heat dissipation port so as to be sandwiched between the partition wall and the end surface of the magnetic circuit facing the partition wall.

The metal partition wall separates the outer space in a high-temperature environment, in which the case of the speaker is installed, from the acoustic space, into which the sound port of the duct of the speaker faces and protrudes. Because the metal partition wall has a large thermal capacity, the metal partition wall can function as a heatsink. By focusing on this point and configuring the speaker such that the thermal conductive sheet is sandwiched between the partition wall and the end surface of the magnetic circuit adjacent to the partition wall, heat generated by the voice coil disposed in the case and heat that accumulates in the magnetic circuit can be efficiently dissipated to the partition wall through the thermal conductive sheet. Therefore, even when the outer space in which the speaker is installed is a high-temperature environment such as an engine compartment, an increase in the temperatures of the voice coil and the magnetic circuit can be suppressed, and, as a result, a good speaker performance can be maintained. In a neodymium magnet of a magnetic circuit used in a high-temperature environment, dysprosium (Dy) is usually included in order to increase the heat resistance of the magnet. The amount of dysprosium, which is an expensive material, can be reduced by configuring the speaker so that an increase in the temperature of the magnetic circuit can be suppressed even in a high-temperature environment. As a result, the cost of the speaker can be reduced.

In the speaker described above, it is preferable that the thermal conductive sheet is a silicone-based thermal conductive sheet, which has high heat conductivity and which is frame-retardant. It is preferable that a part of the magnetic circuit be inserted into the heat dissipation port of the case. In this case, the speaker can be easily manufactured, because the magnetic circuit can be positioned relative to the case by inserting part of the magnetic circuit into the heat dissipation port. In particular, it is preferable that the inserted part of the magnetic circuit be a yoke, and a flat surface of the yoke be exposed in the heat dissipation port. It is preferable that the case be fixed to the partition wall using at least one metal screw. In this case, heat that accumulates in the case can be transferred to the partition wall through the screws, and the thermal conductive sheet can reliably come into pressed contact with the partition wall by tightening the screws.

In the speaker according to an embodiment of the present invention, the elastically deformable thermal conductive sheet is inserted into the heat dissipation port formed in the case, and the speaker can be installed in such a way that the thermal conductive sheet is sandwiched between the partition wall and the end surface of the magnetic circuit adjacent to the partition wall. The partition wall separates the outer space in a high-temperature environment, in which the case of the speaker is installed, from the acoustic space, into which the duct of the speaker faces and protrudes. Thus, the partition wall can be used as a heatsink, and therefore heat of the voice coil and heat of the magnetic circuit can be efficiently transferred to the partition wall through the thermal conductive sheet. Therefore, even when a car speaker such as a subwoofer that has a comparatively large size and for which a high output power is required is installed in an engine compartment, an increase in the temperatures of the voice coil and the magnetic circuit can be suppressed and a good speaker performance can be maintained, because a car body frame, which is the partition wall, functions as a heatsink having a very large thermal capacity.

DETAILED DESCRIPTION OF THE PREFERRED EMBODIMENTS

Figure 2:
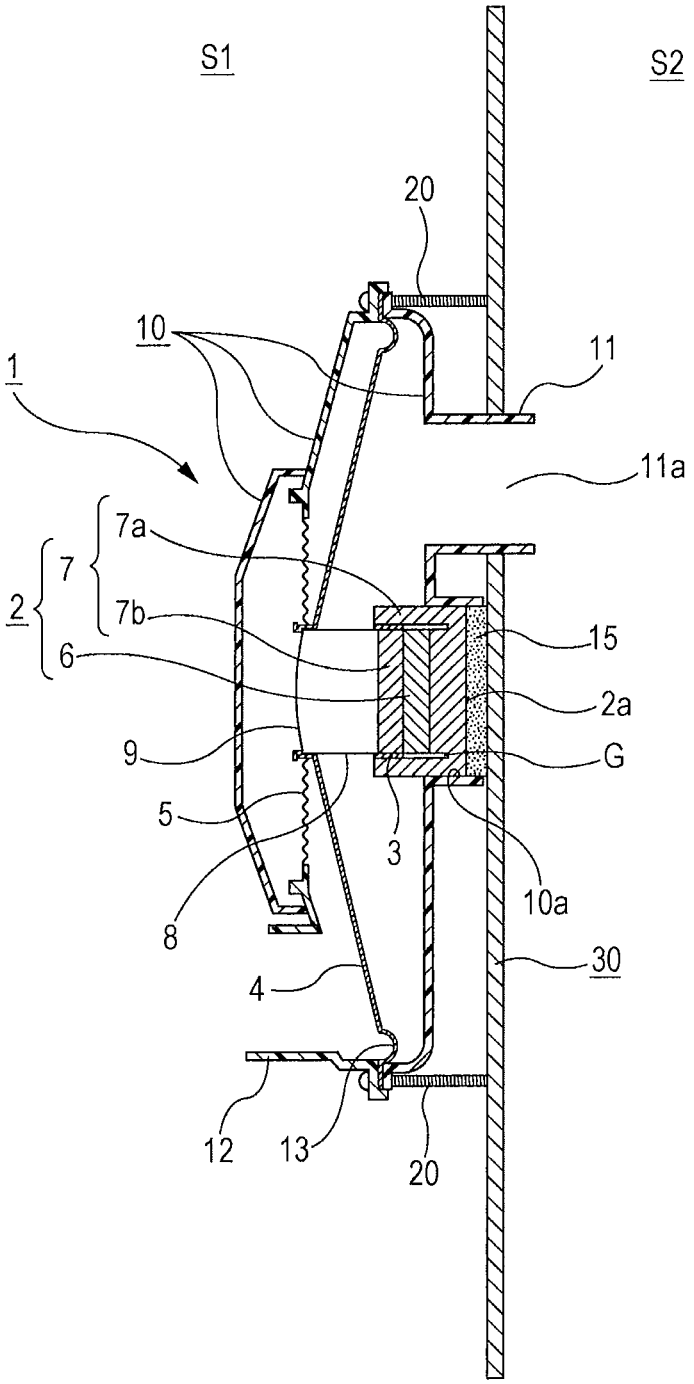
FIG. 2 is a sectional view of the speaker installed in an engine compartment of an automobile.
Figure 4:
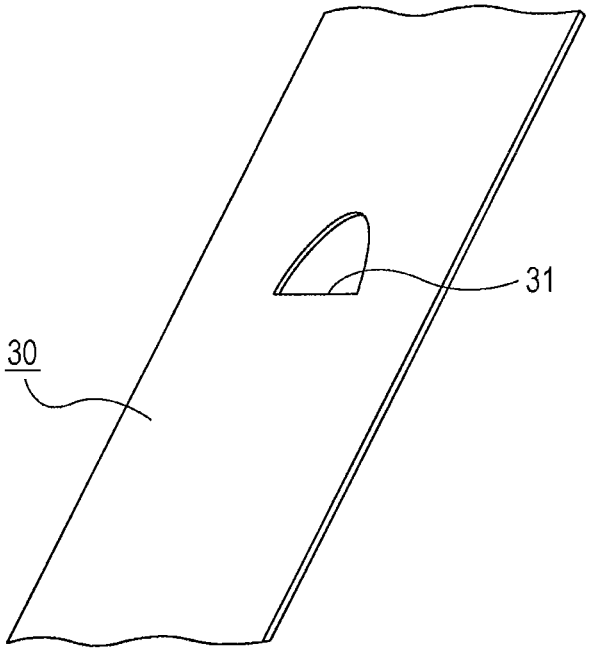
FIG. 4 is a partial perspective view illustrating a hole that is formed in a partition wall illustrated in FIG. 2 and into which a duct is to be inserted.

Hereinafter, an exemplary embodiment of the present invention will be described with reference to the drawings. A speaker 1 according to the exemplary embodiment of the present invention is a car subwoofer. As illustrated in FIG. 2, the speaker 1 is installed in an engine compartment S1 of an automobile, and reproduced sound generated by the speaker 1 is emitted to a cabin space S2. A partition wall 30, which is a vehicle body frame made of a metal, is present between the engine compartment S1 and the cabin space S2. A hole 31 (see FIG. 4) is formed in the partition wall 30; and a duct 11, which protrudes outward from a case 10 of the speaker 1, is inserted into the hole 31. That is, the engine compartment S1 is used as an installation space for installing the speaker 1; a distal open end of the duct 11, which is inserted into the partition wall 30, is a sound port 11*a*; and the sound port 11*a* faces and protrudes into the cabin space S2, which is an acoustic space. The cross-sectional shape of the duct 11 is the same as the shape of the hole 31. The hole 31 may be formed in the partition wall 30 so as to have a shape corresponding to the cross-sectional shape of the duct 11. Alternatively, the duct 11 may be formed in a shape with which the duct 11 can be inserted into a hole that has been already formed in the partition wall 30 (such as a vent hole).

The speaker 1 includes a magnetic circuit 2, a voice coil 3, a diaphragm 4, a damper 5, the case 10, the duct 11, and a rear duct 12. The magnetic circuit 2 has a magnetic gap G. The voice coil 3 is disposed in the magnetic gap G and is driven by electromagnetic interaction that occurs when an electric current is applied. The diaphragm 4 is substantially cone-shaped and vibrates together with the voice coil 3. The damper 5 has an annular shape and elastically supports the voice coil 3 and the diaphragm 4. The magnetic circuit 2, the voice coil 3, the diaphragm 4, the damper 5, and the like are disposed in the case 10. The duct 11 and the rear duct 12 protrude from the case 10. The magnetic circuit 2 is fixed to the case 10. When the speaker 1 is installed in the engine compartment S1, a distal open end (sound port 11*a*) of the duct 11 faces and protrudes into the cabin space S2, and a distal open end of the rear duct 12 faces and protrudes into the engine compartment S1.

The magnetic circuit 2 includes a magnet 6 and a yoke 7, which form a magnetic path. In the present exemplary embodiment, the yoke 7 includes an outer yoke 7*a*, which is cup-shaped, and an inner yoke 7*b*, which is disk-shaped. The magnet 6 is disk-shaped and is interposed between the yokes 7*a* and 7*b*. The magnetic gap G is formed between the outer peripheral surface of the inner yoke 7*b* and a part of the inner peripheral surface of the outer yoke 7*a* adjacent to an open end of the outer yoke 7*a*. Magnetic flux that passes through the magnetic circuit 2 crosses the magnetic gap G.

The voice coil 3 is wound around a bobbin 8 having a cylindrical shape. An electrical audio signal can be applied to the voice coil 3 through a lead wire (not shown). An inner peripheral portion of the diaphragm 4 and an inner peripheral portion of the damper 5 are bonded to an end of the bobbin 8 (an end away from the magnetic gap G). The end of the bobbin 8 is closed by a dustproof cap 9. The diaphragm 4 is made from a cone paper or the like. An outer peripheral portion of the diaphragm 4 is supported by the case 10 through an edge damper 13. An outer peripheral portion of the damper 5 is also supported by the case 10.

In the present exemplary embodiment, the diaphragm 4 has a shape that widens rightward in FIG. 2. Because the diaphragm 4 is disposed around the magnetic circuit 2, the speaker 1 has a small thickness. Alternatively, the diaphragm 4 may be oriented in a direction opposite to that of FIG. 2 (may have a shape that widens leftward in FIG. 2). As a further alternative, the voice coil 3 may be formed so as to have a cylindrical shape and the bobbin 8 may be omitted.

Figure 1:
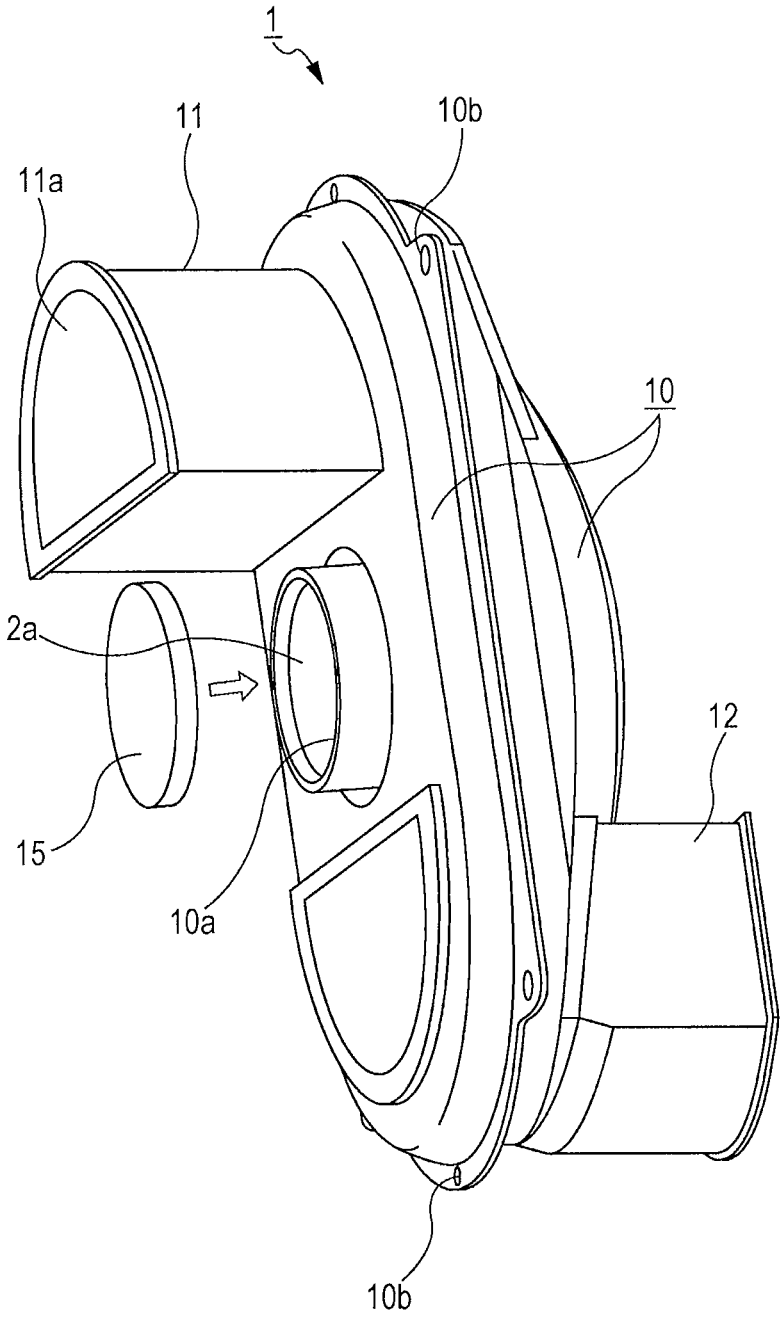
FIG. 1 is an external perspective view of a speaker according to an exemplary embodiment of the present invention.

The case 10, the duct 11, and the rear duct 12 are each made of a synthetic resin and are integrated with each other using fasteners such as screws. The case 10 is a low-profile box-like member. The duct 11 and the rear duct 12 protrude from the case 10 in opposite directions. A heat dissipation port 10*a* is formed in a central portion of a surface of the case 10 facing the partition wall 30 (a surface from which the duct 11 protrudes). A flat bottom surface of the outer yoke 7*a* is exposed in the heat dissipation port 10*a*. The heat dissipation port 10*a* is cylindrical and protrudes in the same direction as the duct 11 does, and the outer yoke 7*a* is fixed in place with the bottom surface thereof being inserted into the heat dissipation port 10*a*. A thermal conductive sheet 15 having a high thermal conductivity is inserted into the heat dissipation port 10*a*. As illustrated in FIG. 2, the thermal conductive sheet 15 is sandwiched between the partition wall 30 and an end surface 2*a* of the magnetic circuit 2 adjacent to the partition wall 30. The thermal conductive sheet 15 is made by cutting a silicone-based thermal conductive sheet, which is flame-retardant and elastically deformable, into a disk shape having a diameter substantially the same as the inside diameter of the heat dissipation port 10*a* (see FIG. 1). The end surface 2*a* of the magnetic circuit 2 corresponds to the bottom surface of the outer yoke 7*a*.

The duct 11 guides reproduced sound generated by the speaker 1, which is installed in the engine compartment S1, to the cabin space S2. The rear duct 12, which has an opening facing the engine compartment S1, is provided in order to adjust the back pressure in the case 10.

Attachment holes 10*b* (see FIG. 1) are fowled in an outer peripheral portion of the case 10. The case 10 is fixed to the partition wall 30 by screwing metal screws 20 (see FIG. 2) through the attachment holes 10*b*.

In the speaker 1 having the structure described above, when an electrical audio signal is applied to the voice coil 3 disposed in the magnetic gap G, the voice coil 3 is moved leftward and rightward in FIG. 2 due to known electromagnetic interaction, and air in the case 10 is vibrated by the diaphragm 4 that moves together with the voice coil 3, and, as a result, reproduced sound is emitted to the cabin space S2 through the sound port 11*a* of the duct 11.

It is necessary to take special measures to dissipate heat from the speaker 1, because the speaker 1 is disposed in the engine compartment S1, which is a high-temperature environment. Therefore, as described above, the heat dissipation port 10*a*, in which the end surface 2*a* of the magnetic circuit 2 is exposed, is formed in the case 10, and the thermal conductive sheet 15 is inserted into the heat dissipation port 10*a* so as to be sandwiched between the partition wall 30 and the end surface 2*a* of the magnetic circuit 2. That is, while the case 10, which is disposed in the engine compartment S1, is being fixed to the partition wall 30 by tightening the screws 20, the thermal conductive sheet 15, which has been inserted into the heat dissipation port 10*a*, becomes elastically deformed and compressed, and therefore the thermal conductive sheet 15 reliably comes into pressed contact with the partition wall 30 and the end surface 2*a* of the magnetic circuit 2. Thus, heat of the voice coil 3 and heat of the magnetic circuit 2 in the engine compartment S1 is more easily transferred to the partition wall 30 through the thermal conductive sheet 15. Moreover, the partition wall 30, which is a vehicle body frame made of a metal, has a very large thermal capacity. Therefore, heat of the voice coil 3 and heat of the magnetic circuit 2 can be efficiently transferred to the partition wall 30.

Figure 3:
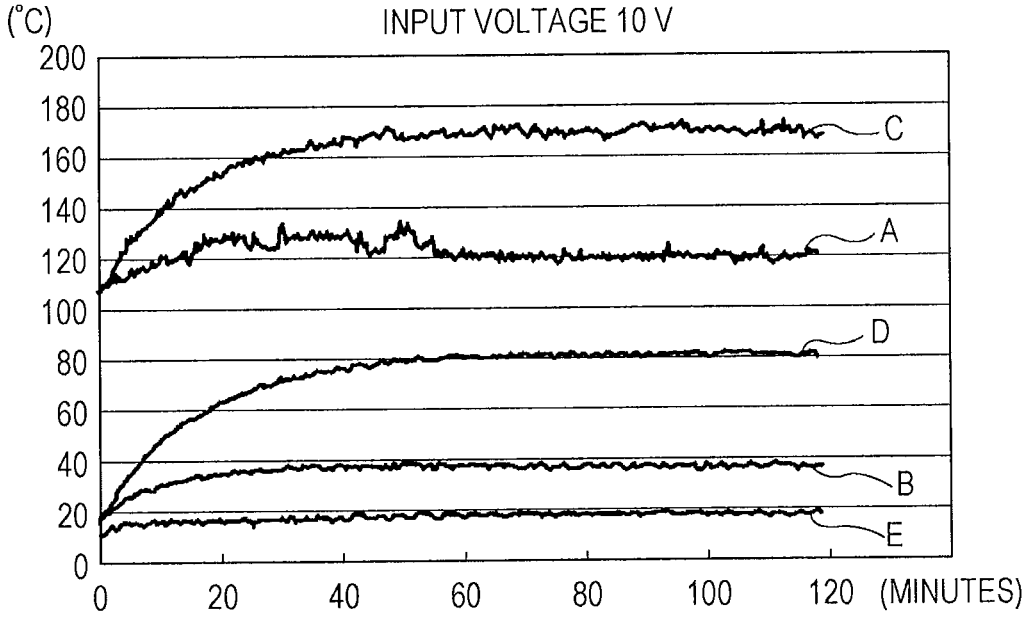
FIG. 3 is a graph showing changes in the temperatures of a voice coil and a yoke illustrated in FIG. 2 and changes in the temperatures of a voice coil and a yoke according to a comparative example.

FIG. 3 is a graph showing the results of measuring changes in the temperatures of the voice coil 3 and the yoke 7 in the engine compartment S1 when an electrical audio signal is supplied with an input voltage of 10 V with time (min). The change in the temperature of the voice coil 3 is represented by a curve A, the change in the temperature of the yoke 7 is represented by a curve B, and the change in the temperature in the vehicle cabin is represented by a curve E. Moreover, changes in the temperatures of the voice coil 3 and the yoke 7 of a comparative example are also measured. In the comparative example, the thermal conductive sheet 15 is removed and the space between the partition wall 30 and the end surface 2*a* of the magnetic circuit 2 is filled with air. In FIG. 3, the change in the temperature of the voice coil 3 of the comparative example is represented by a curve C and the change in the temperature of the yoke 7 of the comparative example is represented by a curve D.

As can be seen from FIG. 3, in the comparative example, the temperature of the voice coil 3 increases to about 170° C. and the temperature of the yoke 7 increases to about 80° C. in about one hour from the time when application of an electric current was started. Therefore, the voice coil 3 may become loose or the magnet (neodymium magnet) 6 of the magnetic circuit 2 may become demagnetized. In contrast, in the present exemplary embodiment, heat can be efficiently dissipated to the partition wall 30 through the thermal conductive sheet 15. Therefore, the temperature of the voice coil 3 is maintained at about 120° C. and the temperature of the yoke 7 is maintained at about 40° C. even when about two hours have elapsed from the time when application of an electric current was started. Therefore, it is not likely that the voice coil 3 becomes loose or the magnet 6 becomes demagnetized, and the speaker 1 in the engine compartment S1, which is a high-temperature environment, can be reliably used.

As heretofore described, in the speaker 1 according to the present exemplary embodiment, the elastically deformable thermal conductive sheet 15 is inserted into the heat dissipation port 10*a* formed in the case 10. The speaker 1 is installed in such a way that the thermal conductive sheet 15 is sandwiched between the partition wall 30 and the end surface 2*a* of the magnetic circuit 2 disposed in the case 10. The partition wall 30 is made of a metal and separates the acoustic space S2 from the engine compartment S1, which is a high-temperature environment in which the case 10 is disposed. Thus, the partition wall (vehicle body frame) 30 having a very large thermal capacity can function as a heatsink, and therefore heat of the voice coil 3 and heat of the magnetic circuit 2 can be efficiently transferred to the partition wall 30 through the thermal conductive sheet 15. As a result, increase in the temperatures of the voice coil 3 and the magnetic circuit 2 in the engine compartment S1 can be suppressed and a good speaker performance can be maintained. Accordingly, the speaker 1, which is a subwoofer that has a comparatively large size and for which a high output power is required, can be installed in the engine compartment S1 and reliably used.

Because the heat dissipation performance of the speaker 1 is increased and increase in the temperature of the magnetic circuit 2 can be efficiently suppressed even under a high-temperature environment, the amount of dysprosium, which is an expensive material needed to increase the heat resistance of the magnet (neodymium magnet) 6, can be reduced. As a result, the cost of the speaker 1 can be reduced.

In the present exemplary embodiment, the case 10 of the speaker 1 is attached to the partition wall 30 using the metal screws 20. Therefore, heat that accumulates in the case 10 can be transferred to the partition wall 30 through the screws 20, and the thermal conductive sheet 15 can reliably come into pressed contact with the partition wall 30 while the screws 20 are being tightened. Also in this respect, high heat dissipation effect can be obtained.

In the present exemplary embodiment, the magnetic circuit 2 is fixed to the case 10 with the bottom surface of the outer yoke 7*a* being inserted into the heat dissipation port 10*a*. Therefore, the magnetic circuit 2 can be easily and reliably positioned relative to the case 10, so that the speaker 1 can be easily manufactured.

The present invention can be applied to a speaker that is installed in a high-temperature environment other than the engine compartment to increase the heat dissipation effect of the speaker. The speaker is not limited to a subwoofer.

While there has been illustrated and described what is at present contemplated to be preferred embodiments of the present invention, it will be understood by those skilled in the art that various changes and modifications may be made, and equivalents may be substituted for elements thereof without departing from the true scope of the invention. In addition, many modifications may be made to adapt a particular situation to the teachings of the invention without departing from the central scope thereof. Therefore, it is intended that this invention not be limited to the particular embodiments disclosed, but that the invention will include all embodiments falling within the scope of the appended claims.

What is claimed is:

1. A speaker comprising:

a magnetic circuit having a magnetic gap;

a voice coil disposed in the magnetic gap;

a diaphragm that vibrates together with the voice coil;

a case in which the magnetic circuit, the voice coil, and the diaphragm are disposed; and a duct protruding from the case, the duct including a sound port that is a distal open end of the duct, the sound port facing and protruding into an acoustic space, wherein the case is disposed in an outer space that is separated from the acoustic space by a partition wall made of a metal, wherein the speaker is installed in such a way that the duct is inserted into a hole that is formed in the partition wall, wherein a heat dissipation port in which an end surface of the magnetic circuit facing the partition wall is exposed is formed in the case, and an elastically deformable thermal conductive sheet is inserted into the heat dissipation port so as to be sandwiched between the partition wall and the end surface of the magnetic circuit facing the partition wall when the speaker is attached to the partition wall; and wherein the acoustic space is a vehicle cabin, the outer space is a space within the vehicle that is outside of a vehicle cabin, and the partition wall is a wall of the vehicle cabin.

2. The speaker according to claim 1, wherein the thermal conductive sheet is a silicone-based thermal conductive sheet.

3. The speaker according to claim 1, wherein a part of the magnetic circuit is at least partially inserted into the heat dissipation port.

4. The speaker according to claim 3, wherein the part of the magnetic circuit is a yoke, and a flat surface of the yoke is exposed in the heat dissipation port.

5. The speaker according to claim 3, wherein the case is fixed to the partition wall using at least one metal fastener.

6. The speaker according to claim 1, wherein the outer space is an engine compartment of the automobile.

7. A speaker comprising:

a magnetic circuit having a magnetic gap;

a voice coil disposed in the magnetic gap;

a diaphragm that vibrates together with the voice coil;

a case in which the magnetic circuit, the voice coil, and the diaphragm are disposed; and a duct protruding from the case, the duct including a sound port that is a distal open end of the duct, the sound port facing and protruding into an acoustic space of a vehicle, wherein the case is disposed in an outer space that is separated from the acoustic space by a partition wall, wherein the speaker is installed in such a way that the duct is inserted into a hole that is formed in the partition wall, wherein a heat dissipation port in which a part of the magnetic circuit is exposed is formed in the case, and a thermal conductive material is sandwiched between the exposed part of the magnetic circuit and a metal part of a vehicle body frame; and wherein the acoustic space is a vehicle cabin, the outer space is a space within the vehicle that is outside of a vehicle cabin, and the partition wall is a wall of the vehicle cabin.

8. The speaker according to claim 7, wherein the thermal conductive material is a silicone-based thermal conductive sheet.

9. The speaker according to claim 7, wherein the part of the magnetic circuit is at least partially inserted into the heat dissipation port.

10. The speaker according to claim 9, wherein the part of the magnetic circuit is a yoke, and a surface of the yoke is exposed in the heat dissipation port.

11. The speaker according to claim 9, wherein the case is fixed to the metal body frame part using at least one metal fastener.

12. The speaker according to claim 7, wherein the outer space is an engine compartment.

13. A method of installing a speaker wherein the speaker includes a case and a duct protruding from the case to form a sound port that is a distal open end of the duct, the method comprising:

disposing the case in an outer space that is separated from an acoustic space by a partition wall made of a metal, where the case houses a magnetic circuit having a magnetic gap; a voice coil disposed in the magnetic gap; and a diaphragm that vibrates together with the voice coil;

installing the speaker so that the duct is inserted into a hole that is formed in the partition wall; and attaching the speaker to the partition wall, wherein a heat dissipation port in which part of the magnetic circuit is exposed is formed in the case, and a deformable thermal conductive sheet is inserted between the partition wall and the exposed part of the magnetic circuit when the speaker is attached to the partition wall; and wherein the acoustic space is a vehicle cabin, the outer space is a space within the vehicle that is outside of a vehicle cabin, and the partition wall is a wall of the vehicle cabin.

14. The method according to claim 13, wherein the thermal conductive sheet is an elastic silicone-based thermal conductive sheet.

15. The method according to claim 13, wherein part of the magnetic circuit is at least partially inserted into the heat dissipation port.

16. The method according to claim 15, wherein the part of the magnetic circuit is a yoke, and a surface of the yoke is exposed in the heat dissipation port.

17. The method according to claim 15, wherein the case is attached to the partition wall using at least one thermal conductive fastener.

18. The method according to claim 13, wherein the outer space is an engine compartment of the vehicle.

* * * * *